US008307587B2

(12) United States Patent
Nordhoff et al.

(10) Patent No.: US 8,307,587 B2
(45) **Date of Patent: *Nov. 13, 2012**

(54) WATER DRAINAGE DEVICE

(76) Inventors: Scott Nordhoff, Bedford, IN (US); Ingrid J. Nordhoff, Bedford, IN (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/366,565

(22) Filed: Feb. 6, 2012

(65) Prior Publication Data

US 2012/0131863 A1 May 31, 2012

Related U.S. Application Data

(63) Continuation of application No. 12/389,072, filed on Feb. 19, 2009, now Pat. No. 8,109,046.

(51) Int. Cl.
*E02D 19/00* (2006.01)

(52) U.S. Cl. ..... 52/169.5; 52/302.3; 52/741.3

(58) Field of Classification Search ..... 52/98, 100, 52/169.5, 287.1, 302.3, 302.6, 741.3; 220/6, 220/7, 23.83, 520; 446/109, 111, 112, 122, 446/487, 488; 405/43; 404/4
See application file for complete search history.

(56) References Cited

U.S. PATENT DOCUMENTS 3,368,316 A * 2/1968 Crowder ..... 52/592.1
3,613,323 A * 10/1971 Hreha ..... 52/169.5
4,185,429 A * 1/1980 Mendola ..... 52/274
4,590,722 A * 5/1986 Bevelacqua ..... 52/302.3
4,773,195 A * 9/1988 Waller ..... 52/302.3
5,406,758 A * 4/1995 Baum ..... 52/169.5
5,662,508 A * 9/1997 Smith ..... 446/128
5,765,323 A * 6/1998 Bevilacqua ..... 52/169.5
6,052,959 A * 4/2000 LaBrosse ..... 52/302.6
2005/0204653 A1* 9/2005 Matthews ..... 52/169.5
2007/0044396 A1* 3/2007 Janesky ..... 52/169.5
2007/0130873 A1* 6/2007 Fisher ..... 52/596
2008/0190045 A1* 8/2008 Janesky ..... 52/169.5

* cited by examiner

*Primary Examiner* — Brian Glessner
*Assistant Examiner* — Adriana Figueroa
(74) *Attorney, Agent, or Firm* — Woodard, Emhardt, Moriarty, McNett & Henry LLP

(57) ABSTRACT

A construct for making a drainage device for a basement waterproofing system is made from a sheet of waterproof material with two generally parallel sides. A series of longitudinal slots is provided parallel to one of the sides, and a series of tabs that fit in the slots is provided along the other side. The bottom surface is scored to provide a series of fold lines to facilitate folding the construct into a rectangular tubular shape, with the tabs fitting into the slots to hold the shape. Perforations are provided in the device to allow water to flow easily through three of the sides of the device when folded to its rectangular tubular shape. A portion of the device may be folded upward to cover the lower portion of a building wall, or a separate piece may be used to bridge the gap between the device and the wall.

4 Claims, 5 Drawing Sheets

WATER DRAINAGE DEVICE

CROSS-REFERENCE TO RELATED APPLICATIONS

This application is a continuation of U.S. application Ser. No. 12/389,072, filed Feb. 19, 2009 now U.S. Pat. No. 8,109,046, the entire contents of which are hereby incorporated herein by reference.

FIELD OF THE INVENTION

The present invention relates generally to materials and methods for use in water drainage systems, and more particularly to a device and method for providing a basement waterproofing system.

BACKGROUND TO THE INVENTION

Basement drainage systems have historically used perforated drain tiles surrounded by gravel and placed in a trench around the inside and/or outside perimeter of a building. The perforated tile forms a pipe line which relieves hydrostatic pressure by collecting and diverting water away from the building, such as to a storm sewer. Such systems are frequently referred to as French drain tile systems.

It has long been known that such drainage systems may be difficult and expensive to install. Accordingly, a need has long existed for improved drainage systems that provide effective performance but are easier and/or less expensive to install. The present invention addresses that need.

SUMMARY OF THE INVENTION

Briefly describing one aspect of the present invention, there is provided a blank for forming a drainage device for a basement waterproofing system. The blank is made from a sheet of waterproof material with two generally parallel sides. A series of longitudinal slots is provided parallel to one of the sides, and a series of tabs that fit in the slots is provided along the other side. The bottom surface is scored to provide a series of fold lines to facilitate folding the construct into a rectangular tubular shape, with the tabs fitting into the slots to hold the shape. Perforations are provided in the device to allow water to flow easily through three of the sides of the device when folded to its rectangular tubular shape. The upper portion of the device may be sized to extend to and be folded upward to cover the lower portion of a building wall when the device is installed two to twelve inches from the wall, or a separate piece may be used to bridge the gap between the device and the wall.

DETAILED DESCRIPTION OF THE INVENTION

Figure 1:
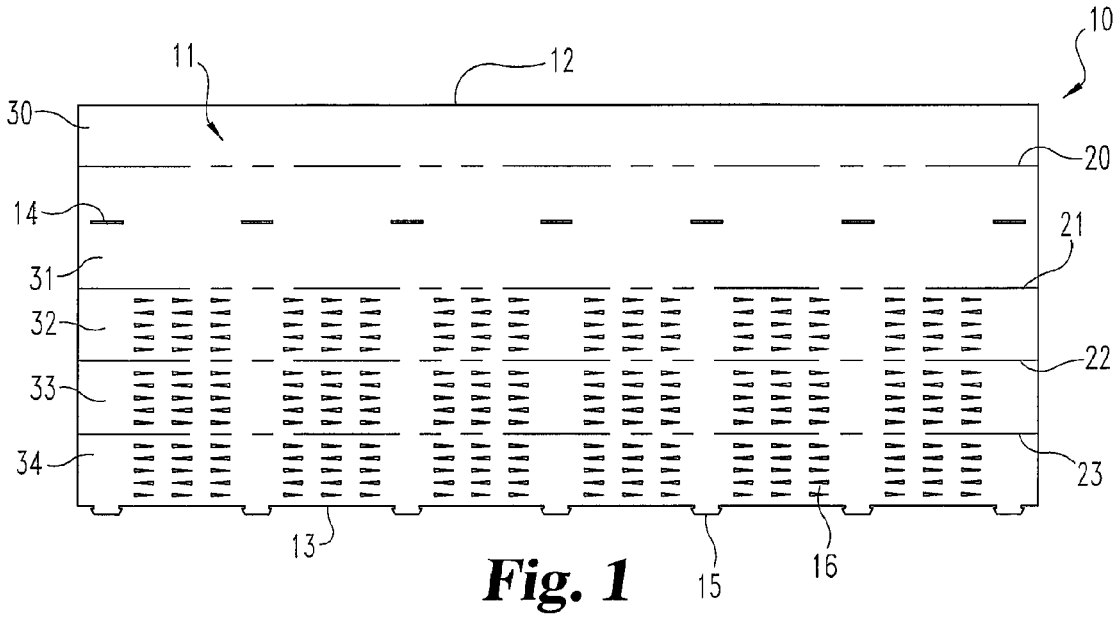
FIG. 1 shows one embodiment of the drainage device of the present invention in its unfolded form.

For the purposes of promoting an understanding of the principles of the invention, reference will now be made to certain embodiments and specific language will be used to describe the same. It will nevertheless be understood that no limitation of the scope of the invention is thereby intended, such alterations and further modifications of the illustrated embodiments being contemplated as would normally occur to one skilled in the art to which the invention relates.

As indicated above, one aspect of the present invention relates to a lightweight, easily transportable roll of material that can be cut to length and assembled to form a drainage device for facilitating the drainage of water from the basement of a building. The material may be scored on one side to facilitate folding into a substantially closed tube, which may have a rectangular shape. One edge of the material may be provided with tabs that cooperate with corresponding slots to facilitate securing the material in its closed tube shape. A desired length of material is cut from the roll to provide a drainage device of the specific length that is needed.

In one embodiment the device includes a portion that is folded "upward" to cover a portion of a wall. The wall covering portion may be an extension of the top surface of the rectangular tube so that water that seeps from the wall behind the "upward" portion is directed into the drainage device.

In one embodiment the device is provided in two parts. One of the parts is a rectangular tube shaped member generally as described above, and the other part is an "L"-shaped piece that provides the "upward" portion described above and also extends horizontally to connect to the rectangular tube-shaped member. By providing several series of slots in the horizontal portion of this second piece, the distance between the upward portion and the tube-shaped member may be varied.

The drainage device may be made of any one or a combination of waterproof materials. In certain preferred embodiments the device is made of a material that is lightweight, yet strong enough to resist collapsing when used in waterproofing applications. Examples of materials that may be used include, but are not limited to, polyethylenes (including high density polyethylene), polypropylenes, polystyrenes, polyvinyl chlorides, polyurethanes, polycarbonates, acrylics, polyethylene terephthalates, polyamides, polyesters, acrylonitrile butadiene styrenes, polyvinylidene chlorides, synthetic rubbers, etc. High density polyethylene is preferred for certain embodiments.

The sheet of material used to make the device has two "sides" or "surfaces"—a top side surface and a bottom side surface—and two substantially parallel edges—a first edge and a second edge. The sheet also has two ends—a first end and a second end—but since the ends have no distinguishing features other than that they are cut to provide the needed length, they are of less interest to this description of the preferred embodiments.

One of the sides/surfaces (preferably the bottom) is scored to define a series of fold lines. The scores facilitate folding the material, and are spaced appropriately for forming a substantially closed device by making a series of folds. In one preferred embodiment there are three folds, although in other embodiments fewer or more folds may be provided and used.

The drainage device pre-form may include perforations or slots to facilitate water flow into the device.

To illustrate one method for practicing the invention, a drainage trench may be dug below the floor around the inside perimeter of a building. Alternatively, a trench may be provided around the outside perimeter of a building, or at other location desired to be protected from water. As is known to the art, when a trench is dug inside an existing structure it is common that a portion of the existing floor (generally concrete) will first need to be removed.

The trench may be of substantially any dimensions, but is commonly about 6-18 inches deep and 6-18 inches wide, most commonly about 12 inches deep and about 12 inches wide. The length is generally determined by the size of the area to be protected. In most cases the trench is dug to a depth near, but not below, the depth of the bottom of the building foundation.

To use one embodiment, the roll of material is unrolled to a length appropriate to provide a drainage device for an area to be drained, and that portion of the material is cut from the roll. The piece of material is laid flat, and folds are made along the fold lines that have been scored into the material. In one preferred embodiment there are three folds, making a rectangular tube shape. The tabs along one edge are inserted into the slots on the other side of the material, thus locking the material closed in a rectangular tube shape.

If the material has additionally been scored to make an upward fold, that fold is made so that the rectangular tube shape extends to an upward "L"-shaped portion.

If the material is provided with a second piece to make the "L"-shaped portion, the second piece is folded upward and the "L"-shaped piece is joined to the rectangular tube by inserting the tabs through a series of slots which are provided in the second piece. Thus, in this embodiment the tabs pass through two sets of slots—a first set in the first (rectangular tube) piece of material, and a second set in the "L"-shaped piece.

In a related, two-piece embodiment, multiple rows of slots are provided in the second piece. The multiple rows are spaced so that the user has a choice of how far from the upward bend the lower portion will be attached. This allows the user to select one from among several distances from the wall to position the rectangular portion of the device.

The device may be fashioned for use in a corner by cutting a piece from the sheet and bending the folded material to fit the corner. In the description and drawings below the corner is a 90° corner, but other bends or corners may be similarly provided by cutting a different sized piece from the sheet to accommodate the bend/corner.

Pins, nails, brackets, etc., may be used to hold the drainage device in place.

The space around the device may be left empty, or it may be filled with gravel or a synthetic material such as the tubes described in applicant's copending application Ser. No. 11/409,386, the entire contents of which are hereby incorporated herein by reference.

When synthetic material is used to fill around the device, the synthetic material may be of substantially any shape and size effective to fill in around a drainage tile, although synthetic rocks that simulate natural gravel are preferred for certain applications. In some preferred embodiments the synthetic rocks may be tubular shaped, such as the tubular members shown in applicant's copending application Ser. No. 11/409,386. Such tubular members may be referred to as mini-tubes. Synthetic rocks of different shapes and/or sizes may be used together, and in some cases synthetic rocks may be used with natural rock. The synthetic rocks may function as a filler material to fill in around drainage tiles and to facilitate the flow of water into and through the tiles.

In some preferred embodiments the largest dimension of the synthetic tubular members is less than 2 inches, more preferably between 0.5 inches and 1.5 inches, and most preferably between 0.75 inches and 1.25 inches. In other preferred embodiments the synthetic tubular members have a largest dimension of less than 3 inches, more preferably between 0.5 and 2.5 inches, and most preferably between 1.0 and 2.0 inches. In other embodiments the largest dimension of the synthetic tubular members is greater than 3 inches.

After the device is provided in the trench, concrete or other solid flooring material may then be provided over the device to provide an appropriate floor. The concrete is preferably poured to a depth of at least three or four inches.

Figure 2:
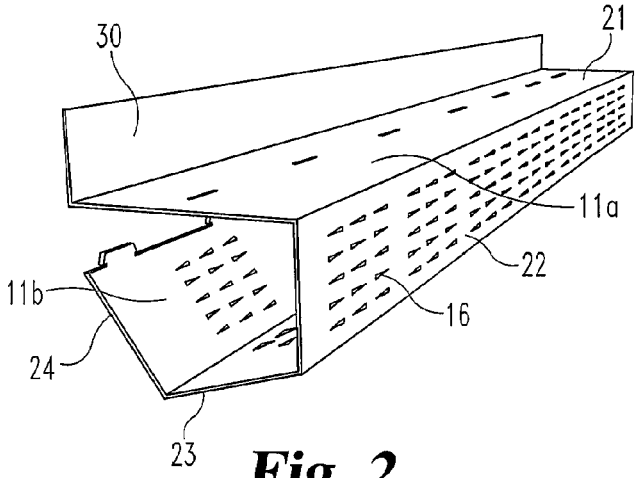
FIG. 2 shows the drainage device of FIG. 1 as it is being folded to its folded form.
Figure 3:
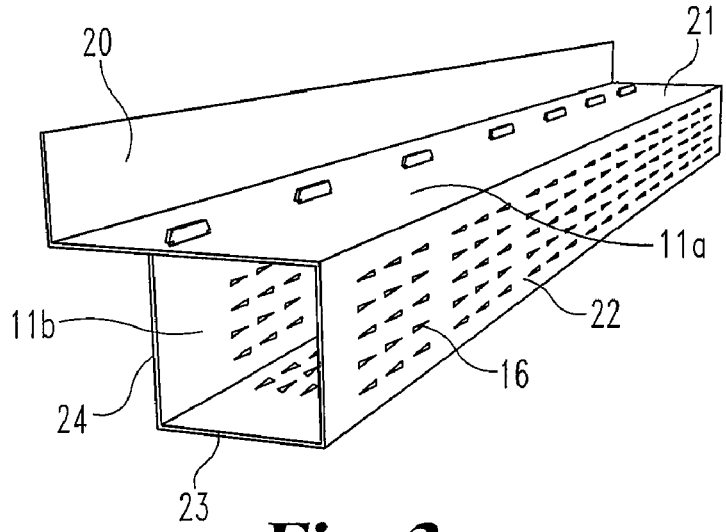
FIG. 3 shows the drainage device of FIG. 1 in its folded form.
Figure 4:
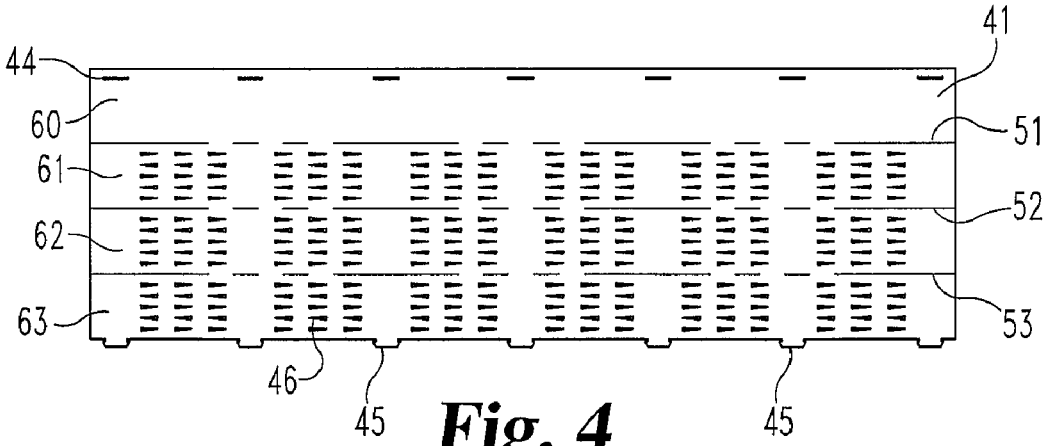
FIGS. 4 and 5 show another embodiment of the drainage device of the present invention in its unfolded form, with FIG. 4 showing one piece of the two-piece system, and FIG. 5 showing a second piece of the two-piece system.
Figure 5:
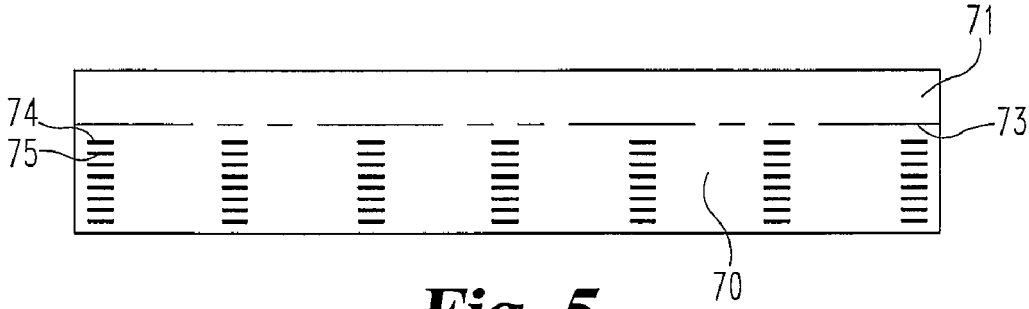
Figure 6:
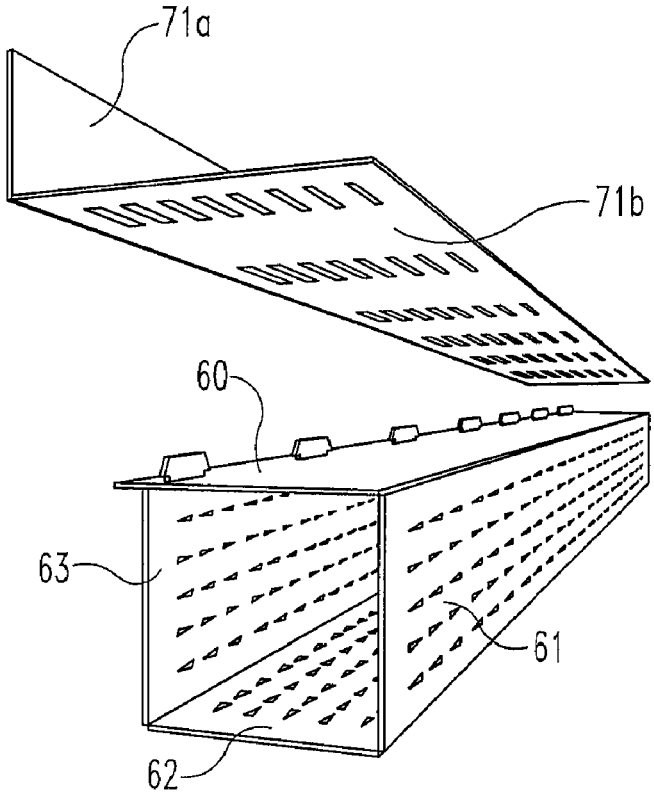
FIG. 6 shows the drainage device of FIGS. 4 and 5 as the two pieces are being positioned for connection.
Figure 7:
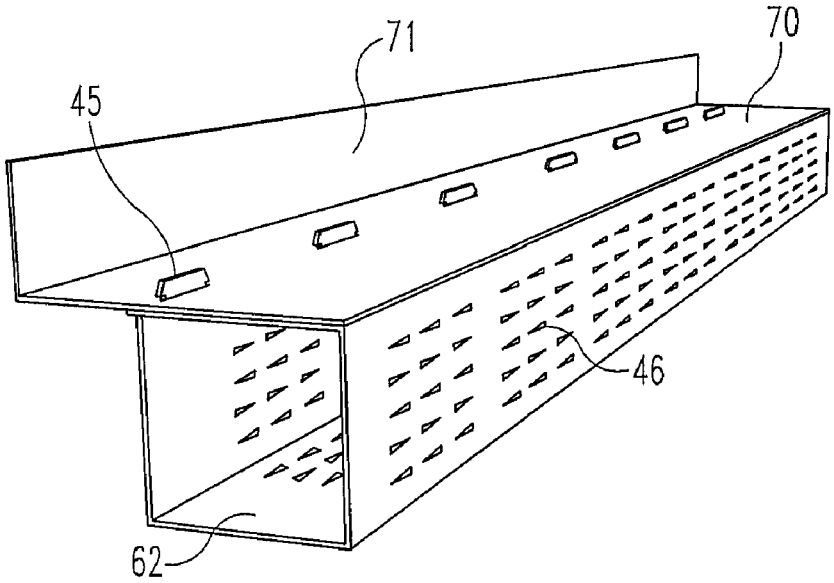
FIG. 7 shows the drainage device of FIGS. 4-6 with the two pieces connected.

Referring now to the drawings, FIGS. 1-3 show one embodiment of the inventive device. In that embodiment blank 10 includes a sheet 11 of waterproof material having a top surface 11*a* and a bottom surface 11*b* and two generally parallel sides 12 and 13. A series of longitudinal slots 14 is provided substantially parallel to and nearer one of said two sides, which in the illustrated embodiment is side 12. A series of tabs is provided on the other side 13. Tabs 15 are sized and positioned to be received in slots 14. Bottom surface 11*a* is scored to provide a multiplicity of generally parallel fold lines 21, 22, and 23 to facilitate folding the construct to a rectangular tubular shape. Sheet 11 also includes a plurality of perforations 16 sized and positioned to be effective for allowing water to flow easily through three of the sides of the device when folded to its rectangular tubular shape.

In the illustrated embodiment there are three fold lines 21-23 scored into bottom surface 11*b* to divide the construct into four regions corresponding to the top 31, front 32, bottom 33, and rear 34 sides of the device when folded to its rectangular tubular shape. Perforations 16 are provided in the front, bottom, and rear sides to allow water to flow therethrough.

A fold line 20 may also be scored into top surface 11*a* of the construct to facilitate folding the construct in a direction opposite the direction of the other folds. Fold line 20 facilitates sub-dividing the top side of the construct into a fourth region 30 corresponding to a wall-facing portion.

To use the blank to make a drainage device, the length that is needed is determined by measuring the length of the trench in which the device will be placed. The appropriate length of material is cut from the roll, and is laid flat. The blank is folded along the scored fold lines 21, 22, and 23 in the bottom surface 11*b* of the blank, with the folds preferably being 90° folds. Tabs 15 are inserted into slots 14 to secure the device in its folded, tube shaped configuration. The scored fold line 20 in the upper surface 11*a* is folded to provide a 90° fold in the opposite direction, thus providing a section that will extend upward against the wall when the device is installed.

The drainage device is then placed in the trench, and a fill material is optionally provided around the device. Concrete or other solid flooring material is then preferably poured or laid over the device to provide an appropriate floor.

In the embodiment shown in FIGS. 4-7, the device is provided in two parts. In that embodiment the construct includes a first sheet 41 of waterproof material having a top surface 41*a* and a bottom surface 41*b* and two generally parallel sides, 42 and 43. A series of longitudinal slots 44 are located substantially parallel to and nearer side 42. Tabs 45 are provided along edge 43, and are sized and positioned to be received in slots 44.

Bottom surface 41*b* is scored with fold lines 51, 52, and 53 to provide a multiplicity of generally parallel fold lines to facilitate folding the first sheet into a first structure having a rectangular tubular shape. A plurality of perforations 46 are sized and positioned to be effective for allowing water to flow easily through three of the sides of the structure when folded into its rectangular tubular shape.

A second sheet 71 of waterproof material having a top surface 71*a* and a bottom surface 71*b* is also provided. The top surface of second sheet 71 is scored to provide a fold line 73 generally parallel to the sides to facilitate folding the second sheet in an "L" shape. A first series of longitudinal slots 74 substantially parallel to fold line 73 is sized and positioned to receive tabs 45 of first sheet 41 when the first sheet is folded to its rectangular shape.

Fold lines 51, 52, and 53 are scored into the bottom surface 41*b* of the first sheet to divide the first sheet into four regions 60, 61, 62, and 63 corresponding to the top 60, front 61, bottom 62, and rear 63 sides of the water drainage device when the first sheet 41 is folded to its rectangular tubular shape. In that configuration perforations 46 are provided in the front, bottom, and rear sides.

A second series of longitudinal slots 75 substantially parallel to the first series of longitudinal slots 74 may also be provided. The second series of longitudinal slots 75 are preferably sized and positioned to provide an alternative placement of said first sheet tabs, with the alternative placement allowing the lower portion of the device to be place farther from (or closer to) the wall.

To make and use the two-piece device, the length needed for a particular application is measured and the appropriate length of material is cut. The device is folded to its rectangular shape by folding along the fold lines scored in the material. The tabs are pushed through the corresponding slots to hold the device in its folded shape. The upper piece is then pushed over the folded device so that the tabs of the folded device fit in the slots of the upper piece. If multiple slots are provided in the upper piece, the slots that will provide the appropriate distance from the wall are used. The device is then placed in a drainage trench, and, if desired, the upwardly folded portion of the device is used to cover a portion of the wall.

Figure 8:
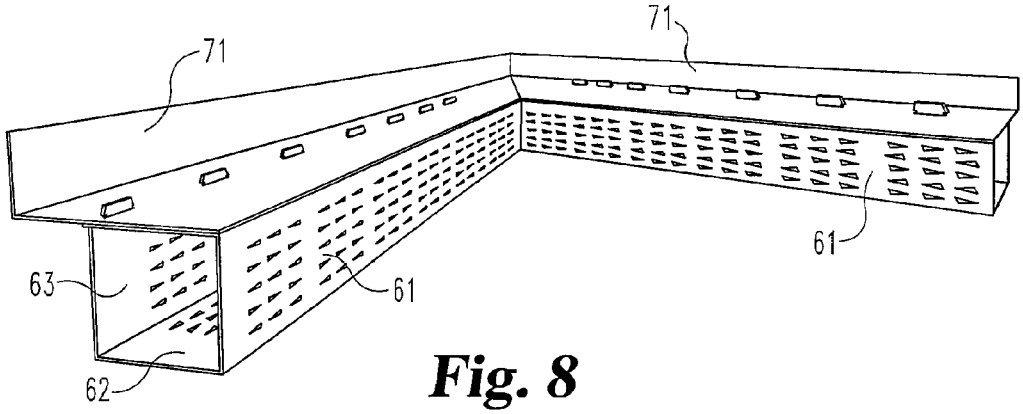
FIG. 8 shows the drainage device of FIG. 5 in a bended form to allow placement in a corner.
Figure 9:
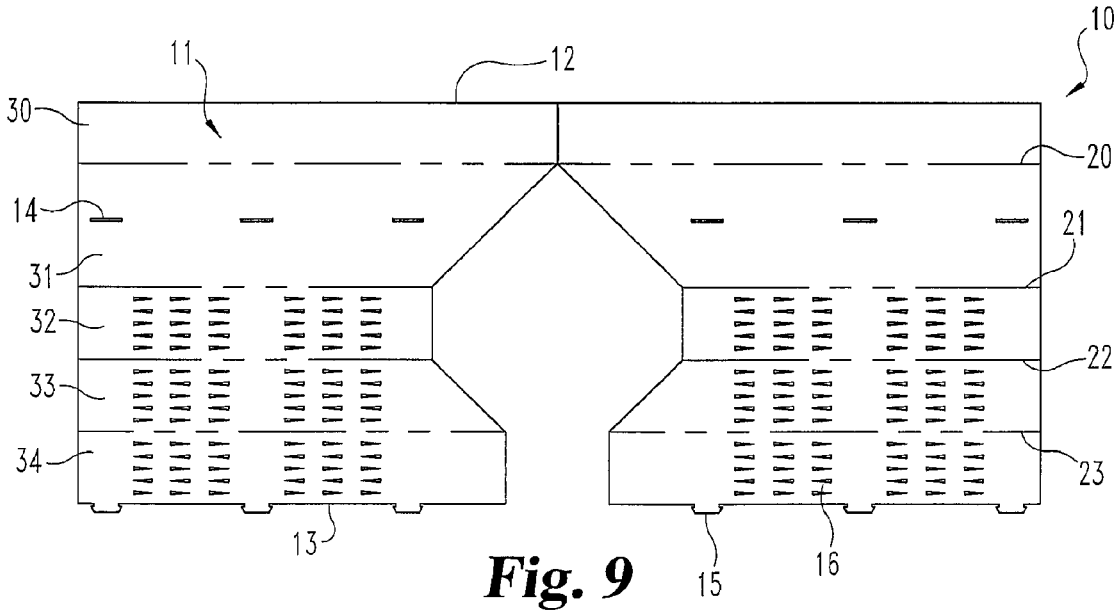
FIG. 9 shows a cut-out that may be used to provide the embodiment of FIG. 8.

When it is desired to provide the device in a corner, a piece of the material is cut to facilitate folding the device to fit in the corner. FIG. 8 shows the device folded to fit in a 90° corner, with FIG. 9 showing the piece that is cut from the material to facilitate folding to a 90° bend.

Figure 10:
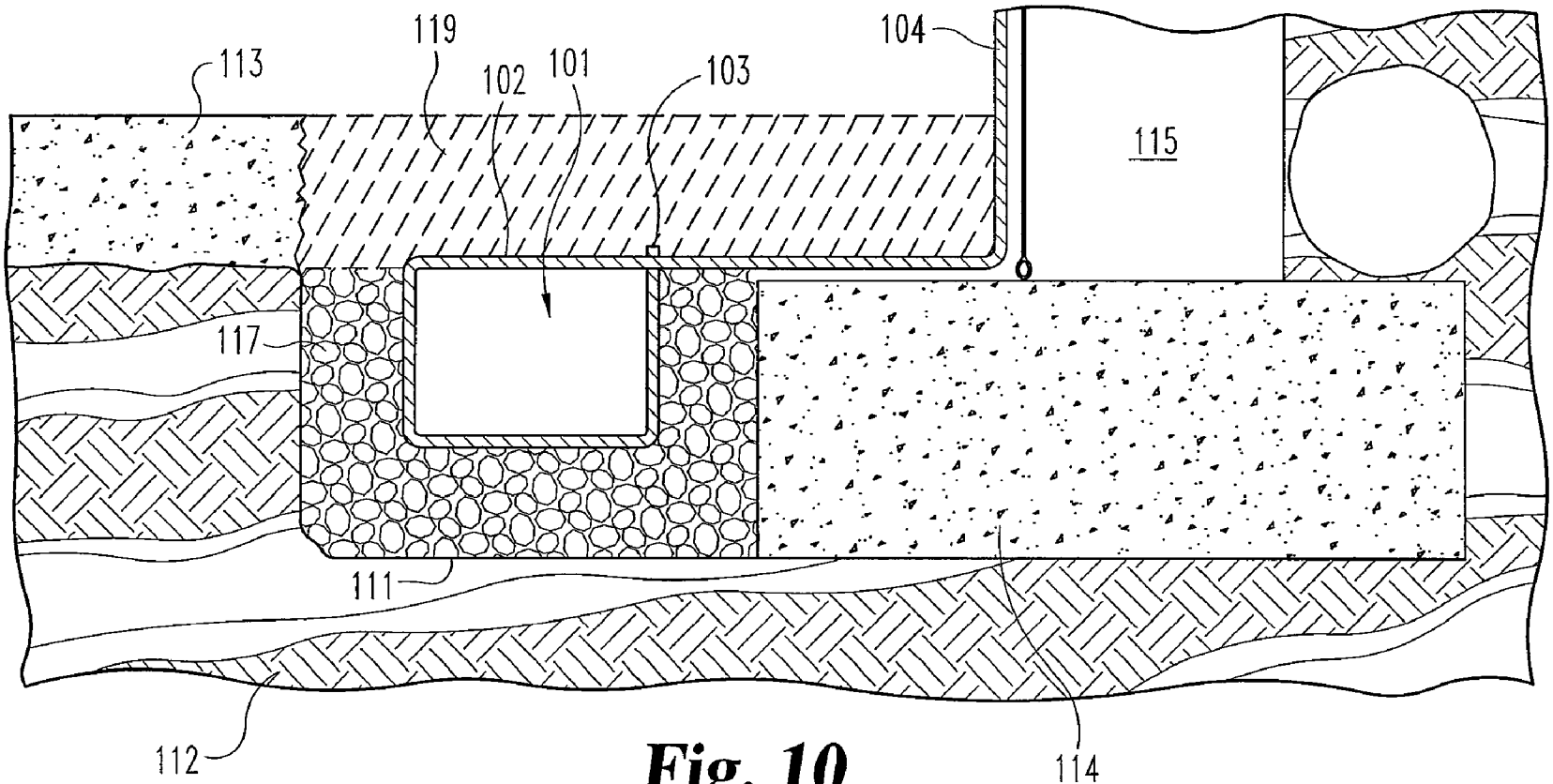
FIG. 10 shows a drainage device according to one embodiment of the present invention installed in a basement waterproofing system.

FIG. 10 shows one embodiment of the inventive device installed in a basement. A trench 111 is provided in soil 112 after removing a portion of concrete floor 113. In the illustrated embodiment trench 111 is adjacent footer 114 which supports foundation wall 115. Device 101 includes a folded sheet 102 of waterproof material, with tabs 103 fitting through slots to hold the device in its folded shape. Device 101 is provided in trench 111 so that perforations in the device allow water to flow into the device and to be directed away from the building. In the illustrated embodiment synthetic rocks 117 are provided around device 101, although the use of such filler material (whether natural or synthetic) is optional, and in other embodiments they are not used. An upper portion 104 of device 101 extends to and upward over a portion of the building wall. Replacement concrete floor 119 is provided over synthetic rocks 117 and over the folded device 102.

While the invention has been illustrated and described in detail in the drawings and foregoing description, the same is to be considered as illustrative and not restrictive in character, it being understood that all changes and modifications that come within the spirit of the invention are desired to be protected.

The invention claimed is:

1. A construct for making a drainage device for a basement waterproofing system; said construct comprising a sheet roll of waterproof material that can be unrolled and cut to provide a sheet having a length defined by the amount of material that is unrolled, and a width defined by the width of the roll, said sheet having a top surface and a bottom surface and two generally parallel sides;

wherein said sheet includes a series of longitudinal slots substantially parallel to and nearer one of said two sides, and wherein the other of said two sides includes a series of tabs sized and positioned to be received in said slots and extending upward above the top surface when said tabs are received in said slots;

wherein one of said top surface and said bottom surface is scored along its length to facilitate folding the sheet in three folds to construct to a rectangular tubular shape construct having open ends;

wherein said sheet includes a plurality of perforations sized and positioned to be effective for allowing water to flow easily through three of the sides of the device when folded to its rectangular tubular shape.

2. The construct of claim 1 wherein the three fold lines scored into the one of said top surface and said bottom surface divide the construct into four regions corresponding to the top, bottom, front, and rear sides of the device when folded to its rectangular tubular shape, and wherein said perforations are provided in the front, bottom, and rear sides.

3. A method of providing a drainage device for a basement waterproofing system, the method comprising:

a) providing a sheet roll of waterproof material that can be unrolled and cut to provide a sheet having a length defined by the amount of material that is unrolled, and a width defined by the width of the roll, said sheet having a top surface and a bottom surface and two generally parallel sides;

wherein said sheet includes a series of longitudinal slots substantially parallel to and nearer one of said two sides, and wherein the other of said two sides includes a series of tabs sized and positioned to be received in said slots and extending upward above the top surface when said tabs are received in said slots;

wherein one of said top surface and said bottom surface is scored along its length in three fold lines to facilitate folding the sheet in three folds to construct to a rectangular tubular shape construct having open ends;

wherein said sheet includes a plurality of perforations sized and positioned to be effective for allowing water to flow easily through three of the sides of the device when folded to its rectangular tubular shape;

b) folding said sheet along at least three of said fold lines to provide a substantially closed construct having open ends and effective for draining water; and c) inserting one or more of said tabs into one or more of said slots to secure the device in its closed configuration said tabs extending upward above the top surface.

4. A method of providing a drainage system to the basement of a building, comprising:

a) providing a trench below the level of the floor of a building;

b) providing a roll of waterproof material that can be unrolled and cut to provide a sheet having a length defined by the amount of material that is unrolled, and a width defined by the width of the roll, said sheet having a top surface and a bottom surface and two generally parallel sides;

wherein said sheet includes a series of longitudinal slots substantially parallel to and nearer one of said two sides, and wherein the other of said two sides includes a series of tabs sized and positioned to be received in said slots;

wherein one of said top surface and said bottom surface is scored along its length to facilitate folding the sheet to construct to a rectangular tubular construct having open ends;

wherein said sheet includes a plurality of perforations sized and positioned to be effective for allowing water to flow easily through three of the sides of the device when folded to its rectangular tubular shape, c) cutting a desired length of material from the roll and unrolling the material to provide a sheet having a length defined by the amount of material that was unrolled, and a width defined by the width of the roll, said sheet having a top surface and a bottom surface and two generally parallel sides;

d) folding the sheet along each of the score lines to provide a rectangular tube having open ends;

e) inserting the tabs into the corresponding slots to hold the construct in its rectangular, tubular orientation said tabs extending upward above the top surface;

f) installing the drainage construct in said trench;

g) filling in around at least a portion of said folded drainage construct with a synthetic filler material sized and configured to facilitate the drainage of water into and through said drain tile; and h) providing a solid flooring material over said synthetic filler material.

* * * * *